US010829923B2

(12) United States Patent
Nordemo

(10) Patent No.: US 10,829,923 B2
(45) Date of Patent: Nov. 10, 2020

(54) PUMP STATION COMPRISING A FLUSH PIPE

(71) Applicant: Xylem Europe GmbH, Schaffhausen (CH)

(72) Inventor: Stefan Nordemo, Stockholm (SE)

(73) Assignee: Xylem Europe GmbH, Schaffhausen (CH)

( * ) Notice: Subject to any disclaimer, the term of this patent is extended or adjusted under 35 U.S.C. 154(b) by 0 days.

(21) Appl. No.: 16/328,949

(22) PCT Filed: Aug. 28, 2017

(86) PCT No.: PCT/EP2017/071487
§ 371 (c)(1),
(2) Date: Feb. 27, 2019

(87) PCT Pub. No.: WO2018/041746
PCT Pub. Date: Mar. 8, 2018

(65) Prior Publication Data

US 2019/0242108 A1 Aug. 8, 2019

(30) Foreign Application Priority Data

Aug. 29, 2016 (EP) ..... 16186113

(51) Int. Cl.
*E03F 5/22* (2006.01)
*E03F 5/10* (2006.01)

(52) U.S. Cl.
CPC ..... *E03F 5/22* (2013.01); *E03F 5/105* (2013.01)

(58) Field of Classification Search
CPC ..... B08B 9/0856; E03F 5/108; E03F 5/105; E03F 5/22
See application file for complete search history.

(56) References Cited

U.S. PATENT DOCUMENTS 4,013,087 A * 3/1977 Hanna ..... E03F 1/002 137/110
6,053,206 A * 4/2000 Johannesen ..... E03F 5/106 137/810

FOREIGN PATENT DOCUMENTS

DE 4330838 A1 3/1995
EP 0472509 A1 2/1992
GB 2486223 A 6/2012

OTHER PUBLICATIONS

International Search Report and Written Opinion for International Application No. PCT/EP2017/071487, dated Nov. 28, 2017—9 pages.

* cited by examiner

*Primary Examiner* — Angelisa L. Hicks
(74) *Attorney, Agent, or Firm* — RatnerPrestia

(57) ABSTRACT

A pump station for intermediate storage of liquid includes a tank configured to house the liquid, an inlet for influent liquid flow, a pump configured to intermittently discharge liquid from the tank, an outlet for effluent liquid flow, and a flush pipe having a lower opening provided in the tank and an upper opening. The lower opening of the flush pipe is located below a pump start liquid level of the tank, and the flush pipe includes a valve configured to open/close fluid communication between the lower opening of the flush pipe and the upper opening of the flush pipe. The valve is located above the pump start liquid level of the tank. The flush pipe is configured to alternate between a primed state and a released state.

8 Claims, 4 Drawing Sheets

PUMP STATION COMPRISING A FLUSH PIPE

TECHNICAL FIELD OF THE INVENTION

The present invention relates generally to the field of pump stations for intermediate storage of liquid, and relates specifically to the field of pump stations for intermediate storage of wastewater, sewage, etc. The pump station comprises a tank configured to house said liquid, an inlet for influent liquid flow, a pump configured to intermittently discharge liquid from the tank, an outlet for effluent liquid flow, an outlet pipe extending between the pump and the outlet of the tank, and a flush pipe having a lower opening provided in said tank and an upper opening, wherein the lower opening of the flush pipe is located below a pump start liquid level of the tank, and wherein the flush pipe comprises a valve configured to open/close fluid communication between the lower opening of the flush pipe and the upper opening of the flush pipe.

BACKGROUND OF THE INVENTION

Pump stations of the above type are regularly used in wastewater networks at one or more positions between the individual household and the wastewater treatment plant. Each pump station comprises at least one pump located in the tank of the pump station, and in many pump stations the pump is operated in an ON/OFF manner. This means that the pump is not active all the times but is instead configured to intermittently discharge liquid from the tank. One commonly used operational strategy is to have a pump start liquid level of the tank and a pump stop liquid level of the tank, wherein the pump start liquid level is located above the pump stop liquid level. Thus, when the liquid level in the tank reaches the pump start liquid level the pump is started/activated, and when the liquid level in the tank drops below the pump stop liquid level the pump is stopped/deactivated.

The influent liquid flow (wastewater/sewage) comprises solid matter, grease, different cleaning agents, soap, etc., and when the pump is inactive a mixture of grease, soap, etc. will accumulate at the surface of the wastewater in the tank and attach/accumulate to the inner wall of the tank at the pump start liquid level of the tank. Accumulation of grease will have negative effect on the structural elements of the pump station and will generate bad smell. Thereto, solid matter that is too heavy to stay suspended in the liquid will settle and accumulate at the bottom of the tank.

One known method of solving these disadvantages is to attach a so-called flush valve, as described in the applicants own EP0472509, to the pump volute of the pump. The flush valve is open at the beginning of each pump cycle, i.e. when the pump is activated, and the pumped media is then discharged through the flush valve instead of through the pump outlet and is thereby circulated in the tank instead of discharged from the pump station. Thereby the accumulated solid matter is re-suspended in the wastewater and the grease, soap, etc. at the surface of the wastewater and at the inner wall of the tank is broken into smaller pieces. After some time the flush valve is automatically closed and the wastewater is then discharged from pump station via the pump outlet. Even though this method is successful, the pump uses energy without transporting wastewater, leading to an unwanted use of extra energy. In some applications the open time of the flush valve, i.e. the wastewater re-circulation time, is almost of the same length as the wastewater discharge time.

Another known method to pump out the grease, soap, etc. from the surface of the wastewater is to let the pump "snore" every now and then, i.e. continue to pump also when the liquid level in the tank is about the same level as the inlet of the pump. This way of operating the pump lead to a mixture of air and liquid being sucked into the pump and a snoring sound will arise. Unfortunately, an excessive use of this operational strategy might lead to noise and vibrations and will also lead to excessive use of energy.

Document DE4330838 disclose a pump station having a tank and a flush pipe arrangement. The flush pipe is primed and fully submerged when the liquid level in the tank reaches the pump start liquid level and the flush pipe is emptied by means of pressurized air provided to the flush pipe before the pump is activated, i.e. when the tank is full. The disclosed flush pipe arrangement requires a lot of energy to be able to empty the flush pipe. Thereto, it is a great and immediate risk that the solid matter in the wastewater will interfere with both the valve of the flush pipe and the lower opening of the flush pipe, leading to faulty operation due to non-closure of the valve and/or blockage of the lower opening.

OBJECT OF THE INVENTION

The present invention aims at obviating the aforementioned disadvantages and failings of previously known pump stations, and at providing an improved pump station. A primary object of the present invention is to provide an improved pump station of the initially defined type which is configured to keep the tank free from solid matter, grease, soap, etc. otherwise accumulated in the tank. It is another object of the present invention to provide a pump station, which use no or negligible amounts of energy for the task of keeping the tank clean from accumulating matter.

SUMMARY OF THE INVENTION

According to the invention at least the primary object is attained by means of the initially defined pump station having the features defined in the independent claim. Preferred embodiments of the present invention are further defined in the dependent claims.

According to the present invention, there is provided a pump station of the initially defined type, which is characterized in that the flush pipe is suspended by a wire assembly, the lower opening of the flush pipe is located above a pump stop liquid level of the tank, and wherein the valve is constituted by a mechanical check valve located above said pump start liquid level of the tank, wherein the mechanical check valve being configured to admit fluid flow in the direction from the lower opening of the flush pipe towards the upper opening of the flush pipe, wherein the flush pipe is configured to alternate between a primed state filled with liquid in level with the pump start liquid level of the tank and a released state empty of liquid, the flush pipe being configured to go from the released state to the primed state when the pump is inactive, the valve is open and the liquid level in the tank increase up to the pump start liquid level and being configured to go from the primed state to the released state when the pump is active, the valve is closed and the liquid level in the tank is at level with the lower opening of the flush pipe.

Thus, the present invention is based on the insight of automatic priming of a flush pipe is obtained during normal rise of the liquid level in the tank when the pump is inactive, wherein the liquid volume in the flush pipe at a later step is used to mix/circulate the wastewater in the tank when the pump is active the liquid level in the tank is low. Thus, energy is stored in the flush pipe in the form of a liquid column located above the liquid level of the tank (i.e. a volume of liquid having a certain potential energy in relation to the liquid level in the tank) when the pump is active, and no added energy is needed to prime the flush pipe and thereby no added energy is needed to clean the tank from accumulating matter.

In a preferred embodiment of the present invention the lower opening of the flush pipe is located below a pump stop liquid level of the tank, wherein the valve is constituted by a controllable valve. This means that the operator can choose/program how often and when the flush pipe shall be emptied into the tank, i.e. each pump cycle, every second pump cycle, etc. and/or once, twice, etc. each pump cycle.

According to the present invention the lower opening of the flush pipe is located above a pump stop liquid level of the tank, wherein the valve is constituted by a mechanical check valve (non-return valve). The mechanical check valve is configured to admit fluid flow in the direction from the lower opening of the flush pipe towards the upper opening of the flush pipe. According to this embodiment the flush pipe is fully automatic and is emptied into the tank each pump cycle.

According to a preferred embodiment the average cross sectional area of the main body of the flush pipe is more than 3 percent of the average cross sectional area of the tank. According to a preferred embodiment the average cross sectional area of the main body of the flush pipe is less than 20 percent of the average cross sectional area of the tank.

Thus the invention concerns a method for mixing the liquid in the tank of a pump station by means of a flush pipe. The pump station and flush pipe are arranged and configured as initially described/defined, wherein said valve of the flush pipe is located above the pump start liquid level. The method comprises the steps of priming the flush pipe and releasing the flush pipe, respectively, in an alternating manner, wherein the priming of the flush pipe takes place when the pump is inactive and the liquid in the tank automatically enters into the flush pipe and wherein the releasing of the flush pipe takes place when the pump is active and the liquid in the flush pipe is returned to the tank. When the pump is inactive the liquid level in the tank rises and when the pump is active the liquid level in the tank drops. The flush pipe is full primed when the liquid level in the tank reaches the pump start liquid level. Preferably the step of releasing the flush pipe takes place when the liquid level in the tank is low, i.e. close to the pump stop liquid level.

Further advantages and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
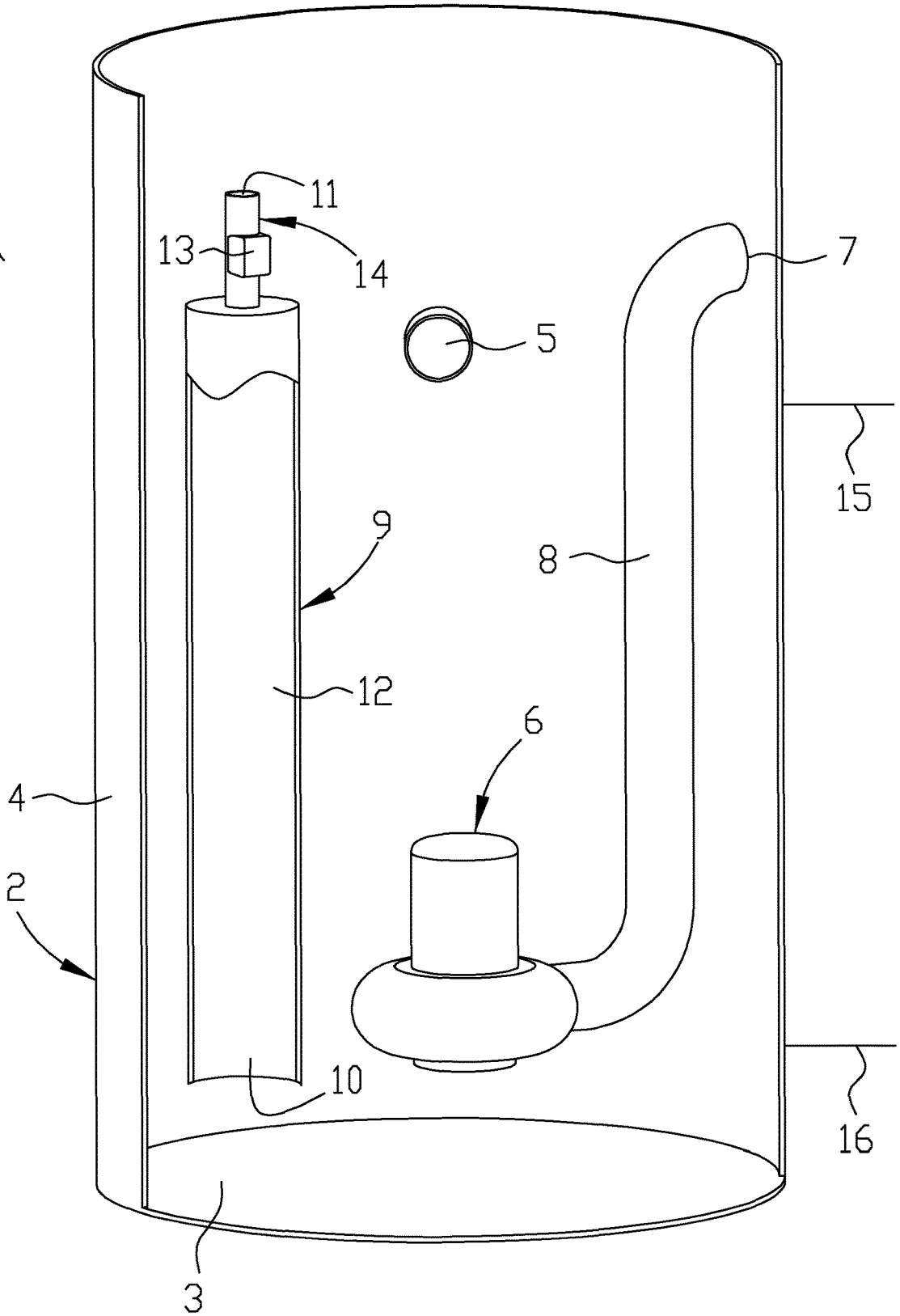
FIG. 1 is a schematic cross sectional perspective view of an inventive pump station.

The present invention relates generally to intermediate storage of liquid, such as wastewater, sewage, etc. in a pump station. FIG. 1 discloses a schematic pump station, generally designated 1. The pump station 1 comprises a tank 2 having a bottom 3 and a circumferential wall 4 extending from said bottom 3. The tank 2 is also known as pump sump, container, receptacle, etc. It shall be pointed out that even though the tank 2 is represented by a vessel having a cylindrical wall 4 in the disclosed embodiments, the wall 4 must not by cylindrical. Actually it is more common that the tank 2 has different cross sectional area at different heights of the pump station 1. The tank 2 is in a conventional way configured to house said liquid.

The pump station 1 comprises an inlet 5 for influent liquid flow, and it shall be pointed out that the inlet 5 may be constituted by several inlet openings. The influent liquid flow originates for instance from different households. Thereto the pump station 1 comprises at least one pump 6 that is configured to intermittently discharge the liquid from the tank 4, i.e. pump the liquid away from the pump station 1. The pump 6 is preferably constituted by a submersible pump located in the tank 2 and partly/fully surrounded by the liquid. The pump station 1 also comprises an outlet 7 for effluent liquid flow, wherein said outlet 7 is connected to the pump 6 via an outlet pipe 8. The inlet 5 and the outlet 7 are preferably located at a similar height in the pump station 1, in an upper portion of the tank 2. A common frequency of operation/activation of the pump 6 is in the range 2-4 times per hour and changes over the day due to varying inflow rate.

The inventive pump station 1 comprises a flush pipe, generally designated 9. The flush pipe 9 comprises a lower opening 10 provided in said tank 2 and an upper opening 11. The wording "provided in" has the meaning that the flush valve 9 mouth into the tank 2 by means of said lower opening 10. According to the preferred embodiment the upper opening 11 of the flush pipe 9 is provided in the tank 2. The lower opening 10 is preferably located at the lowest point of the flush pipe 9. The upper opening 11 is located in the upper portion of the flush pipe 9, preferably the upper opening 11 is located at the top point of the flush pipe 9. The flush pipe 9 is in the disclosed embodiments fully arranged in the tank 2, however, according to a not disclosed embodiment the flush pipe 9 may be partly located outside the tank 2, as long as the lower opening 10 of the flush pipe 9 is provided in said tank 2. The lower opening 10 can according to a non-disclosed embodiment be arranged in the wall 4 of the tank 2, i.e. in level/flush with the inner surface of the wall 4. The flush pipe 9 comprises a main body 12 configured to house the liquid when the flush pipe 9 is in a primed state, and in the disclosed embodiments the main body 12 of the flush pipe 9 is constituted by a cylindrical tube. It shall be pointed out that the main body 12 do not have to be cylindrical, thus the main body 12 may have different cross sectional area at different heights of the pump station 1. The main body 12 may comprise a bend/elbow adjacent the lower opening 10 in order to direct the liquid leaving the flush pipe 9 in a specific direction. The main body 12 may comprise a decreased diameter adjacent the lower opening 10 in order to accelerate the liquid leaving the flush pipe 9. Preferably the lower opening 10 of the flush valve 9 is arranged in a horizontal plane when the flush pipe 9 is primed, as will be described hereinbelow.

According to another embodiment (not disclosed) the main body of the flush pipe is constituted by a segment of the tank, i.e. the tank is divided into two parts by an internal dividing wall, wherein the internal dividing wall and a part of the tank wall constitutes the main body of the flush pipe, and wherein the lower opening is constituted by an opening in the internal dividing wall.

The flush pipe 9 also comprises a valve 13 that is configured to open/close fluid communication between the lower opening 10 and the upper opening 11 of the flush pipe 9. Preferably, the valve 13 is located adjacent the upper opening 11 of the flush pipe 9. In the disclosed embodiments the valve 13 and the upper opening 11 of the flush pipe 9 are located in a tube/hose 14 that is connected to the main body 12 and that has a smaller diameter than the main body 12.

The lower opening 10 of the flush pipe 9 shall be located below a pump start liquid level 15 of the tank 2, and the valve 13 is located above the pump start liquid level 15, in order to prevent any solid matter in the liquid in the main body 12 of the flush pipe 9 to interfere/block the valve 13 when the flush pipe 9 is primed.

According to a preferred embodiment the average cross sectional area of the main body 12 of the flush pipe 9 is equal to or more than 3 percent of the average cross sectional area of the tank 2, preferably more than 6 percent. According to a preferred embodiment the average cross sectional area of the main body 12 of the flush pipe 9 is equal to or less than 20 percent of the average cross sectional area of the tank 2, preferably less than 10 percent. The average cross sectional area of the main body 12 and the tank 2 is measured/determined between the pump start liquid level 15 and the lower opening 10 of the flush pipe 9, and the average cross sectional area of the tank 2 is measured/determined between a flush start liquid level 17 and the bottom 3 of the tank 2.

The energy added to the liquid in the tank 2 when the flush pipe 9 is released must be enough to obtain proper mixing, preferably the energy added should be equal to or more than 100 watt per cubic meter ($W/m^3$), preferably equal to or more than 500 $W/m^3$. It shall be pointed out that an amount of added energy up to and exceeding 1000 $W/m^3$ is also conceivable by means of the inventive flush pipe arrangement. The liquid volume in the primed flush pipe 9 must also be large enough to be able to mix the liquid in the tank 2. The maximum volume of the liquid volume in the primed flush pipe 9 is delimited such that the solid matter that is re-suspended/mixed when the flush pipe 9 is released may not once again settle before the liquid level in the tank 2 drops to a pump stop liquid level 16. The liquid volume of the primed flush pipe 9 shall be equal to or more than 5 percent of the liquid volume of the tank 2 just before the flush pipe 9 is released, preferably more than 10 percent. The liquid volume of the primed flush pipe 9 shall be equal to or less than 30 percent of the liquid volume in the tank 2 just before the flush pipe 9 is released, preferably less than 20 percent. Thereto, the time from releasing the flush pipe 9 until the flush pipe 9 is emptied shall be equal to or less than 5 seconds, preferably less than 3 second. The flush pipe 9 is considered emptied when the liquid level in the flush pipe 9 is at the same height as the liquid level in the tank 2 according to some embodiments, and when the flush pipe 9 is indeed empty according to other embodiments.

The pump 6 is configured to start/activate when the liquid level in the tank 2 reach the pump start liquid level 15. The flush pipe 9 is in the primed state when the liquid level in the tank 2 reaches the pump start liquid level 15. The pump station 1 may comprise a suitable level sensor (not disclosed) in order to detect/determine when the liquid level in the tank 2 reaches the pump start liquid level 15. Thereto, the pump 6 is configured to stop/deactivate when the liquid level in the tank 2 drops below the pump stop liquid level 16 of the tank 2. The pump station 1 may comprise a suitable level sensor (not disclosed) in order to detect/determine when the liquid level in the tank 2 drops below the pump stop liquid level 16. The flush pipe 9 shall go from the primed state to the released/empty state when the pump 6 is active. In an alternative embodiment, or as a supplementary feature, the pump 6 can be stopped at a snore liquid level. The pump 6 starts to snore, draw a mixture of air and liquid, when the liquid level in the tank 2 is at level with the inlet opening of the pump 6. The pump stop liquid level 16 can be the same as the snore liquid level, or above the snore liquid level. If the snore liquid level is below the pump stop liquid level 16, every now and then the pump 6 is programmed to be active until the liquid level in the tank 2 drops to the snore liquid level in order to remove from the tank 2 any matter floating at the liquid surface.

When the pump 6 is not active the tank 2 is refilled by the influent liquid flow in a conventional way. The upper opening 11 of the flush pipe 9 is preferably located above the highest allowable liquid level in the tank 2, in order to prevent any solid matter in the tank 2 to interfere/block the upper opening 11.

Reference is now made to FIGS. 2-5 disclosing a first embodiment of the present invention at different states. Only the tank 2 and flush pipe 9 are disclosed in the figures and the other elements of the pump station 1 are removed for sake of simplicity. In the first embodiment the lower opening 10 of the flush pipe 9 is located below the pump stop liquid level 16 of the tank 2, and the valve 13 is constituted by a controllable valve. The valve shall be constituted by a solenoid valve or another controllable valve having ON/OFF operational characteristic. According to a preferred embodiment the controllable valve shall be biased towards the open state, and when the controllable valve is activated the valve is closed. Thereto the flush pipe 9 may comprise a check valve (non-return valve) as a safety measure if the controllable valve should get stuck in the closed state. The operation of the flush pipe 9 according to the first embodiment will now be described by means of the schematic disclosures in FIGS. 2-5.

Figure 2:
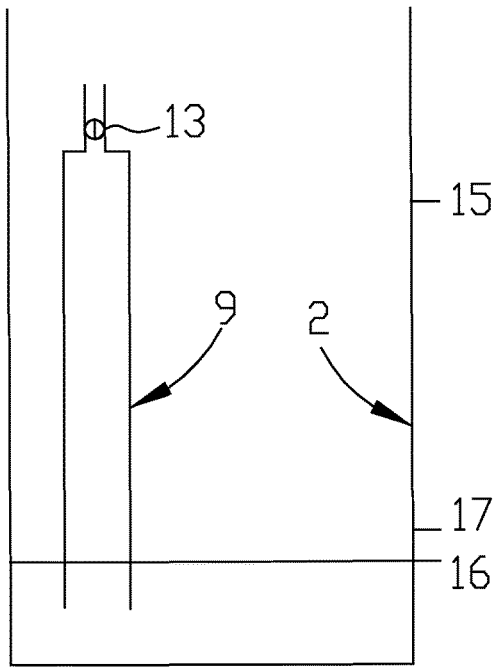
FIGS. 2-5 are schematic cross sectional side views of the tank and flush pipe according to a first embodiment, disclosing the first embodiment in different states.

In FIG. 2 the pump 6 has just been stopped and the liquid level in the tank 2 is located at the pump stop liquid level 16, and the valve 13 is in the open state.

Figure 3:
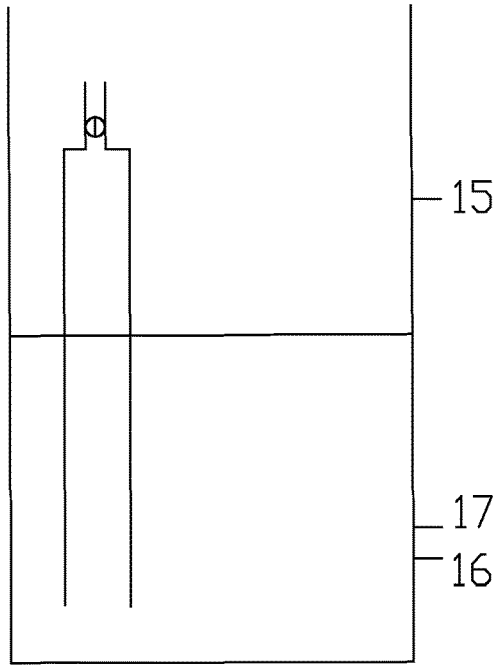

In FIG. 3 the tank 2 is refilled and the valve 13 is kept in the open state such that the air in the main body 12 can escape through the upper opening 11 via the open valve 13. Thereby the main body 12 of the flush pipe 9 is automatically primed/filled with liquid simultaneously as the liquid level in the tank 2 increase/rise. According to an alternative embodiment the valve 13 is kept closed when the liquid level in the tank 2 rises, and then the valve 13 is opened before or at the same time as the liquid level in the tank 2 has reached the pump start liquid level 15 in order to prime the flush pipe 9 with liquid.

Figure 4:
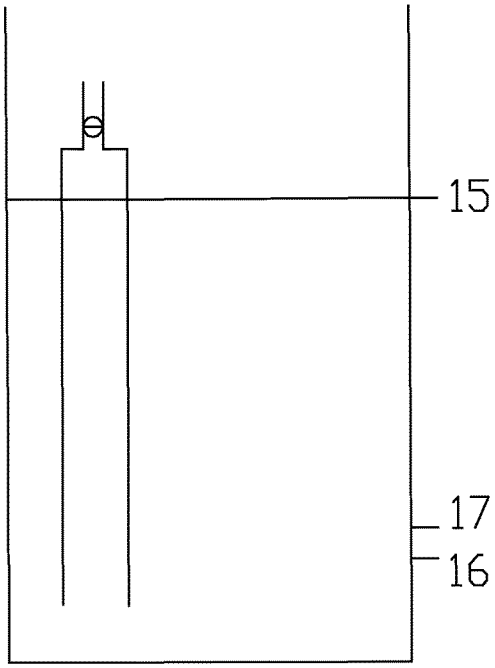

In FIG. 4 the liquid level in the tank 2 has reached the pump start liquid level 15 and the flush pipe 9 is primed and the state of the valve 13 is changed from open to closed. The pump 6 is then activated and when the pump 6 is active and discharge liquid from the tank 2 the liquid level in the tank 2 drops, but the liquid volume in the main body 12 of the flush pipe 9 is remained due to the closed valve 13.

Figure 5:
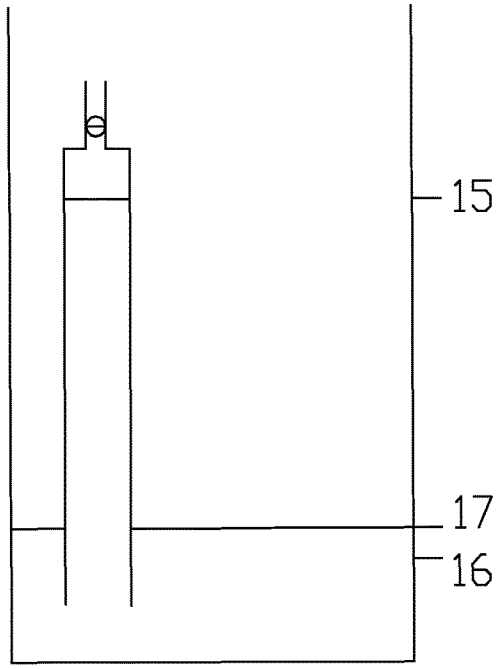

In FIG. 5 the pump 6 is still active and the liquid level in the tank 2 has dropped to the flush start liquid level 17. In the disclosed first embodiment, the flush start liquid level may also be named valve open liquid level. The flush start liquid level 17 is located above the pump stop liquid level 16. The state of the valve 13 is then changed from closed to open, whereby the liquid volume in the main body 12 of the flush pipe 9 will rush down into the tank 2 and mix/circulate the liquid in the tank 2. The pump 6 is still active during the mixing/circulation and continues to discharge liquid until the liquid level in the tank 2 drops to the pump stop liquid level 16, as disclosed in FIG. 2.

It shall be pointed out that the flush pipe 9 can be released each cycle, every second cycle, etc. based on the average/ordinary nature of the influent liquid entering the pump station 1. According to another (not disclosed) embodiment the flush pipe 9 can be partly released by opening the valve 13 when the liquid level in the tank 2 is for instance half way between the pump start liquid level 15 and the pump stop liquid level 16, and then close the valve 13. Thereby about half the liquid volume in the flush pipe 9 is used, and the remaining part of the liquid volume in the flush pipe 9 is released when the liquid level in the tank 2 drops to the flush start liquid level 17.

According to a non-disclosed alternative of the first embodiment, the lower opening 10 of the flush pipe 9 is located below the pump stop liquid level 16 of the tank 2 and above a pump snoring liquid level of the tank 2, and the valve 13 is constituted by a mechanical check valve (non-return valve). The mechanical check valve is configured to admit fluid flow in the direction from the lower opening 10 towards the upper opening 11 of the flush pipe 9. The flush start liquid level is located at the same level as the lower opening 10 of the flush pipe 9, and the flush pipe 9 is only released those pump cycles when the pump 6 is not stopped at the pump stop liquid level but instead continues to be active until the liquid level drops to the pump snoring liquid level.

Reference is now made to FIGS. 6-9 disclosing a second embodiment of the present invention at different states. Only the tank 2 and flush pipe 9 are disclosed in the figures and the other elements of the pump station 1 are removed for sake of simplicity. In the second embodiment the lower opening 10 of the flush pipe 9 is located above the pump stop liquid level 16 of the tank 2, and the valve 13 is constituted by a mechanical check valve (non-return valve). The mechanical check valve is configured to admit fluid flow in the direction from the lower opening 10 towards the upper opening 11 of the flush pipe 9. According to a preferred embodiment the mechanical check valve is constituted by a hinged plate abutting and sealing the upper opening 11 of the flush pipe 9. According to another preferred embodiment the mechanical check valve is constituted by a valve body located in the tube/hose 14 that is connected to the main body 12, wherein the valve body may seal/close the flush pipe by means of gravity and/or a biasing member. The operation of the flush pipe 9 according to the second embodiment will now be described by means of the schematic disclosures in FIGS. 6-9. According to the disclosed second embodiment the flush pipe 9 is suspended in a spring assembly 18 comprising at least one spring, said spring preferably being a helical tension spring.

Figure 6:
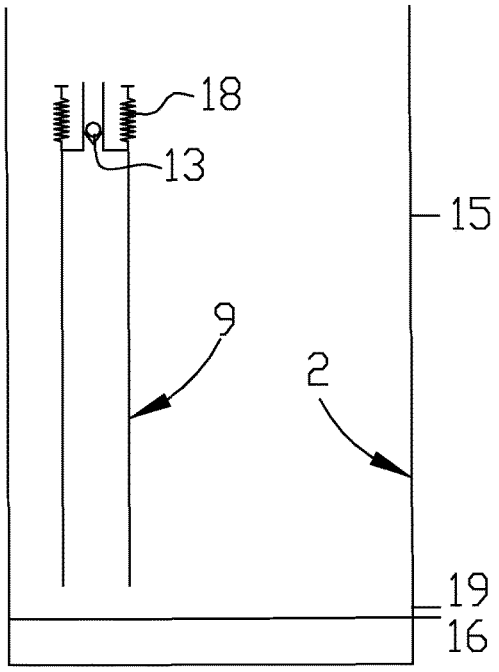
FIGS. 6-9 are schematic cross sectional side views of the tank and flush pipe according to a second embodiment, disclosing the second embodiment in different states.

In FIG. 6 the pump 6 has just been stopped and the liquid level in the tank 2 is located at the pump stop liquid level 16.

Figure 7:
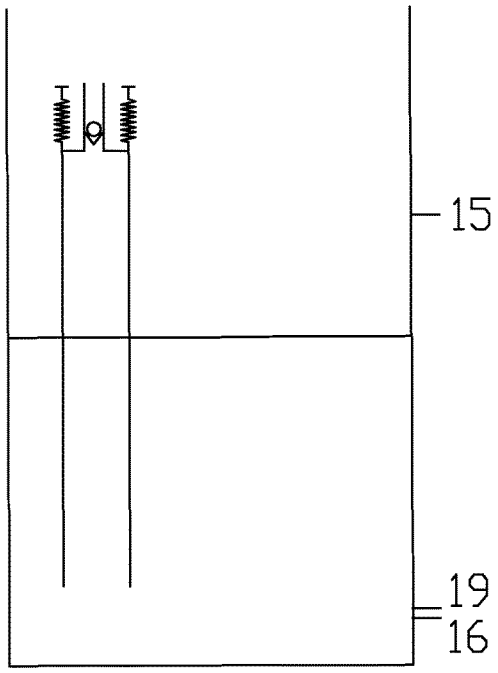

In FIG. 7 the tank 2 is refilled and the valve 13 is in the open state such that the air in the main body 12 can escape through the upper opening 11 via the valve 13. Thereby the main body 12 of the flush pipe 9 is automatically primed/filled with liquid simultaneously as the liquid level in the tank 2 increase/rise.

Figure 8:
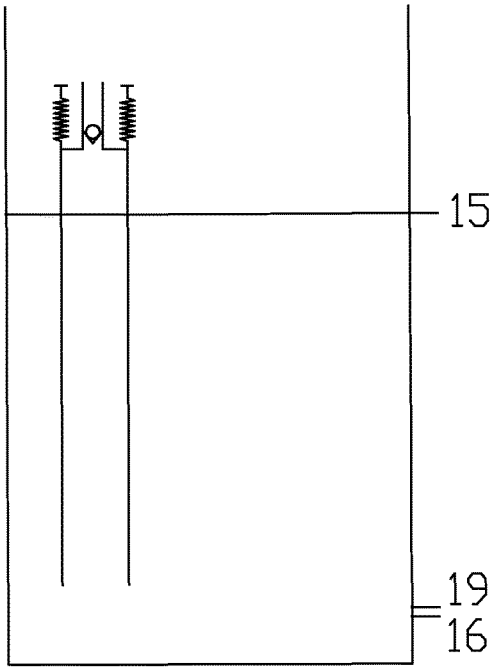

In FIG. 8 the liquid level in the tank 2 has reached the pump start liquid level 15 and the flush pipe 9 is in the primed state and the state of the valve 13 is automatically changed from open to closed. The pump 6 is activated and when the pump 6 is active and discharge liquid from the tank 2 the liquid level in the tank drops, but the liquid volume in the main body 12 of the flush pipe 9 is remained.

When the pump 6 is active and the liquid level in the tank 2 drops, the weight of the liquid volume in the flush pipe 9 that is located above the liquid level in the tank 2 will put tension to the spring assembly 18 and the flush pipe 9 will move downwards from the initial position to a lowermost position. The lowermost position of the flush pipe 9 is preferably equal to or more than 10 centimeters below the initial position, i.e. when the flush pipe 9 is completely empty. The lowermost position of the flush pipe 9 is preferably equal to or less than 20 centimeters below the initial position.

Figure 9:
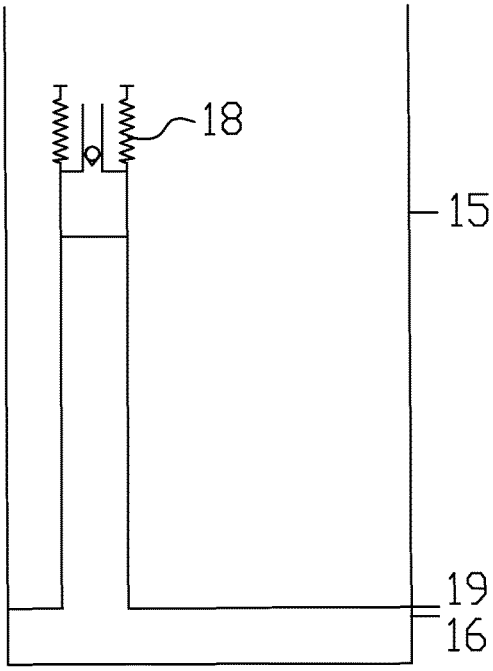

In FIG. 9 the pump 6 is active and the liquid level in the tank 2 has dropped to a flush start liquid level 19. The flush start liquid level 19 is at the same height in the tank 2 as the lower opening 10 of the flush pipe 9 when the flush pipe 9 is in the lowermost position. Thereby, air will start to enter into the main body 12 of the flush pipe 9 via the lower opening 10 such that the liquid volume in the main body 12 of the flush pipe 9 starts to rush down into the tank 2 and mix/circulate the liquid in the tank 2. The valve 13 is still closed. When the liquid volume of the flush pipe 9 is emptied into the tank 2 the liquid level in the tank 2 will rise, but simultaneously the weight of the instantaneously remaining liquid volume in the flush pipe 9 will decrease and the flush pipe 9 is pulled upwards by the spring assembly 18, such that the when the liquid in the flush pipe 9 starts to enter the tank 2 the lower opening 10 of the flush pipe 9 is kept above the instantaneous liquid level in the tank 2. Thus, the upwards movement of the flush pipe 9 compensates for the rising liquid level in the tank 2. If this is not the case, the time for emptying the flush pipe 9 risk to be too long as the lower opening of the flush pipe is then alternately below and above the liquid level in the tank. The pump 6 is still active during the emptying of the flush pipe 9 and continues to discharge liquid until the flush pipe 9 is empty of liquid and the liquid level in the tank 2 drops to the pump stop liquid level 16, as disclosed in FIG. 6.

Reference is now made to FIGS. 10-13 disclosing a third embodiment of the present invention at different states. Only the tank 2 and flush pipe 9 are disclosed in the figures and the other elements of the pump station 1 are removed for sake of simplicity. In the third embodiment the lower opening 10 of the flush pipe 9 is located above the pump stop liquid level 16 of the tank 2, and the valve 13 is constituted by a mechanical check valve (non-return valve). The mechanical check valve is configured to admit fluid flow in the direction from the lower opening 10 towards the upper opening 11 of the flush pipe 9. According to the third embodiment the flush pipe 9 is suspended in an articulated manner in the upper portion of the flush pipe 9, preferably some distance from the upper end of the flush pipe 9. The flush pipe 9 is preferably suspended by a wire assembly, i.e. hanging in wire(s) attached to the upper end of the tank 2.

Figure 10:
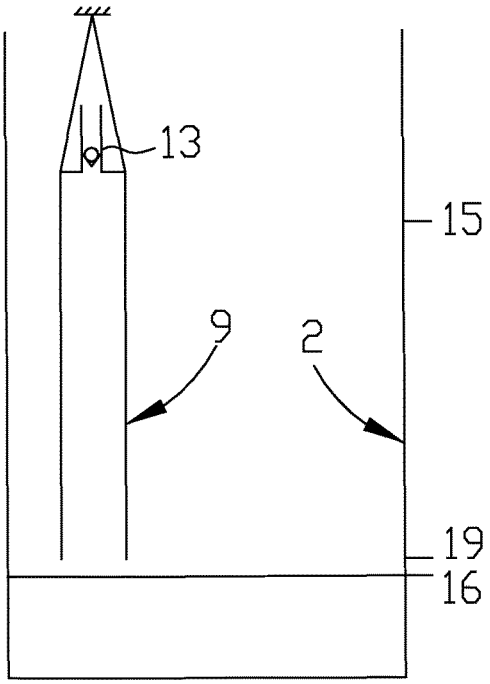
FIGS. 10-13 are schematic cross sectional side views of the tank and flush pipe according to a third embodiment, disclosing the third embodiment in different states.

In FIG. 10 the pump 6 has just been stopped and the liquid level in the tank 2 is located at the pump stop liquid level 16.

Figure 11:
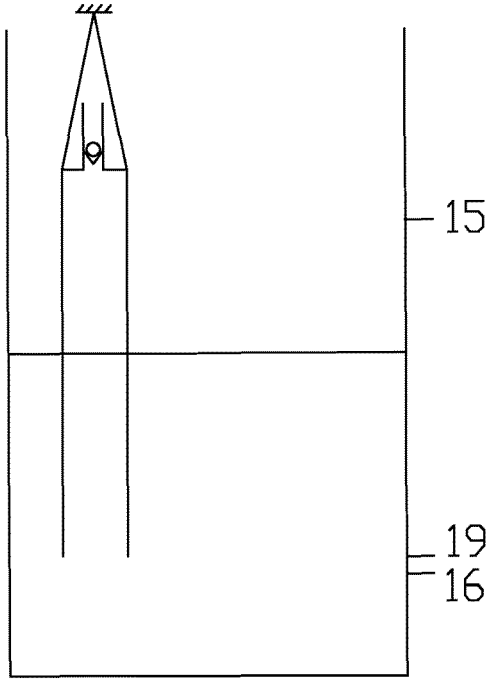

In FIG. 11 the tank 2 is refilled and the valve 13 is in the open state such that the air in the main body 12 can escape through the upper opening 11 via the valve 13. Thereby the main body 12 of the flush pipe 9 is automatically primed/filled with liquid simultaneously as the liquid level in the tank 2 increase/rise.

Figure 12:
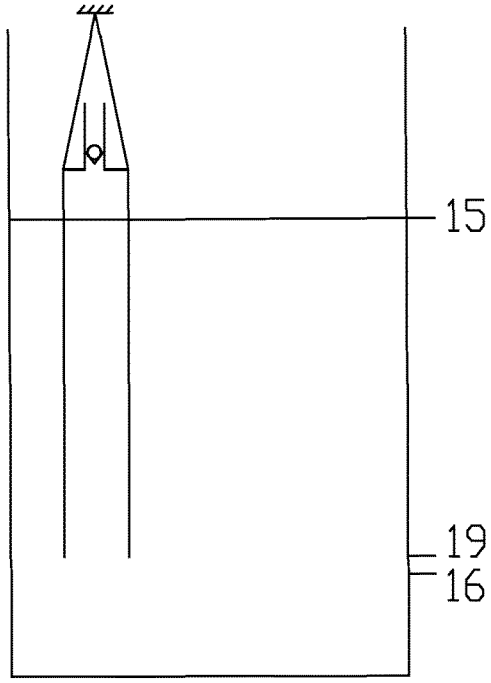

In FIG. 12 the liquid level in the tank 2 has reached the pump start liquid level 15 and the flush pipe 9 is in the primed state and the state of the valve 13 is automatically changed from open to closed. The pump 6 is activated and when the pump 6 is active and discharge liquid from the tank 2 the liquid level in the tank drops, but the liquid volume in the main body 12 of the flush pipe 9 is remained.

Figure 13:
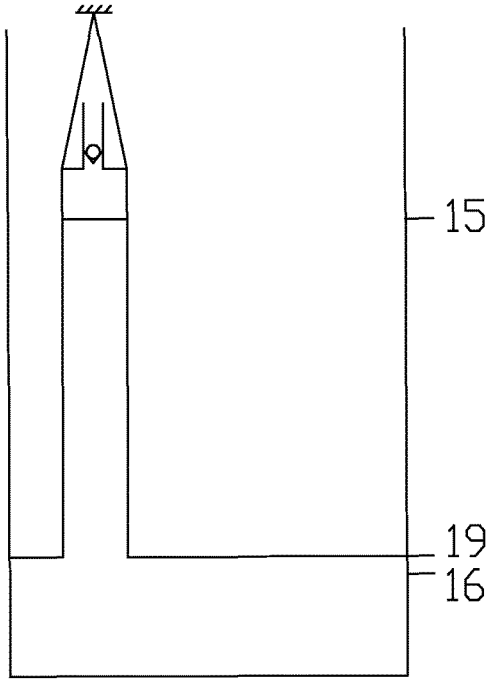

In FIG. 13 the pump 6 is still active and the liquid level in the tank 2 has dropped to the flush start liquid level 19. The flush start liquid level 19 is located above the pump stop liquid level 16. When the liquid level in the tank 2 reaches the flush start liquid level 19 and air starts to enter the flush pipe 9, the turbulence/chaos/waves at the liquid level in the tank 2 will create forces rendering the flush pipe 9 to swing back and forth which will help to empty the flush pipe 9 in short enough time. The capacity of the pump 6 is preferably dimensioned to pump away liquid from the tank 2 at a faster rate than the release rate of the flush pipe 9. Thus, the liquid volume in the main body 12 of the flush pipe 9 will rush down into the tank 2 and mix/circulate the liquid in the tank 2. The pump 6 is still active during the mixing/circulation and continues to discharge liquid until the liquid level in the tank 2 drops to the pump stop liquid level 16, as disclosed in FIG. 10.

According to a non-disclosed alternative of the second and third embodiments, the flush start liquid level is located below the pump stop liquid level 16 of the tank 2 and above a pump snoring liquid level of the tank 2, and the valve 13 is constituted by a mechanical check valve (non-return valve). The flush pipe 9 is only released those pump cycles when the pump 6 is not stopped at the pump stop liquid level but instead continues to be active until the liquid level drops to the pump snoring liquid level.

Thus, in all embodiments the valve 13 is located above said pump start liquid level 15 of the tank 2, and the flush pipe 9 is configured to alternate between a primed state and a released state, the flush pipe 9 being configured to go from the released state to the primed state when the pump 6 is inactive and to go from the primed state to the released state when the pump 6 is active.

Thereto, in all embodiments the lower opening 10 of the flush pipe 9 is preferably located at a distance from the bottom 3 of the tank 2, such that any settled solid matter cannot block or interfere with the lower opening 10.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

Throughout this specification and the claims which follows, unless the context requires otherwise, the word "comprise", and variations such as "comprises" or "comprising", will be understood to imply the inclusion of a stated integer or steps or group of integers or steps but not the exclusion of any other integer or step or group of integers or steps.

The invention claimed is:

1. A pump station for intermediate storage of liquid, comprising:

a tank configured to house the liquid;

an inlet for influent liquid flow;

a pump configured to intermittently discharge liquid from the tank;

an outlet for effluent liquid flow;

an outlet pipe extending between the pump and the outlet of the tank; and a flush pipe having a lower opening provided in said tank and an upper opening, wherein the lower opening of the flush pipe is located below a pump start liquid level of the tank and above a pump stop liquid level of the tank, the flush pipe comprising a valve configured to open/close fluid communication between the lower opening of the flush pipe and the upper opening of the flush pipe;

wherein:

the flush pipe is suspended by a wire or spring assembly;

the valve comprises a mechanical check valve located above said pump start liquid level of the tank, the mechanical check valve configured to discharge air from the flush pipe to admit liquid flow in a direction from the lower opening of the flush pipe towards the upper opening of the flush pipe, the valve configured to alternate between a closed state corresponding to the flush pipe retaining a liquid volume therein, and an open state corresponding to the flush pipe releasing or building liquid therein;

the flush pipe is configured to alternate between (i) a primed state filled to a primed liquid level achieved at the pump start liquid level of the tank and (ii) a released state empty of liquid;

the valve is configured to go from the open state to the closed state when the liquid level in the tank is falling relative to a liquid level in the flush pipe and to go from the closed state to the open state when the liquid level in the tank is rising or when the liquid level in the tank is below a flush start liquid level in the tank, the flush start liquid level in the tank comprising a level at which the lower opening of the flush pipe permits air from the tank to enter the flush pipe; and the wire or spring assembly is configured to permit at least lateral movement of the flush pipe at least during a discharge of liquid from the flush pipe in the open state.

2. The pump station according to claim 1, wherein the valve is located adjacent the upper opening of the flush pipe.

3. The pump station according to claim 1, wherein the upper opening of the flush pipe is provided in said tank.

4. The pump station according to claim 1, wherein the wire or spring assembly comprises the spring assembly, the spring assembly further configured to permit axial movement of the flush pipe during changes in liquid level in the tank.

5. The pump station according to claim 1, wherein an average cross sectional area of a main body of the flush pipe is equal to or more than 3 percent of an average cross sectional area of the tank.

6. The pump station according to claim 1, wherein an average cross sectional area of a main body of the flush pipe is equal to or less than 20 percent of an average cross sectional area of the tank.

7. The pump station according to claim 1, wherein a volume of the flush pipe, taken between the pump start liquid level and the lower opening of the flush pipe, is equal to or more than 5 percent of the volume of the tank taken below a flush start liquid level.

8. The pump station according to claim 1, wherein the volume of the flush pipe, taken between the pump start liquid level and the lower opening of the flush pipe, is equal to or less than 30 percent of the volume of the tank taken below a flush start liquid level.

* * * * *